US006402542B1

(12) United States Patent
Jones

(10) Patent No.: US 6,402,542 B1
(45) Date of Patent: Jun. 11, 2002

(54) ELECTRICAL CONNECTOR

(75) Inventor: Dennis Boyd Jones, Orang City, CA (US)

(73) Assignee: Hon Hai Precision Ind. Co., Ltd., Taipei Hsiena (TW)

( * ) Notice: Subject to any disclaimer, the term of this patent is extended or adjusted under 35 U.S.C. 154(b) by 0 days.

(21) Appl. No.: 09/796,395

(22) Filed: Feb. 28, 2001

(51) Int. Cl.[7] ..... H01R 11/20
(52) U.S. Cl. ..... 439/404; 439/636; 439/907
(58) Field of Search ..... 439/417, 409, 439/404, 411, 412, 636, 637, 405

(56) References Cited

U.S. PATENT DOCUMENTS 3,555,493 A * 1/1971 Baumans ..... 439/404
3,680,032 A * 7/1972 Mosier et al. ..... 439/417
3,710,303 A * 1/1973 Gallager, Jr. ..... 439/404
3,930,706 A * 1/1976 Obuch et al. ..... 439/404
4,781,615 A * 11/1988 Davis et al. ..... 439/417
4,826,445 A * 5/1989 Verhoeven et al. ..... 439/267
5,902,146 A * 5/1999 Hanami ..... 439/405

* cited by examiner

*Primary Examiner*—Neil Abrams
*Assistant Examiner*—Phuong K Dinh
(74) *Attorney, Agent, or Firm*—Wei Te Chung

(57) ABSTRACT

An electrical connector comprises a body portion comprising a vertical portion and a horizontal portion connected to the vertical portion. A reception slot is defined in the vertical portion. A plurality of first contacts are formed in the reception slot. A plurality of second contacts expose from the horizontal portion.

7 Claims, 7 Drawing Sheets

ELECTRICAL CONNECTOR

BACKGROUND OF THE INVENTION

1. Field of the Invention

The present invention relates to an electrical connector, particularly to an electrical connector simultaneously connected to a mother board, a daughter board, and a ribbon cable.

2. The Prior Art

Electrical connectors are used popularly for interconnection between two electrical devices which may be a mother board, a hard drive or the like. Normally, an edge card connector is mounted on a mother board and electrically connects a daughter board to the mother board, while a ribbon cable connector is mounted on a printed circuit board such as a mother board or a daughter board and connects a ribbon cable to the printed circuit board. Therefore, for connections between a mother board, a daughter board, and a ribbon cable at least two electrical connectors must be used, which may occupy space and raise cost. It is requisite to provide a new electrical connector which may electrically connect the mother board, the daughter board, and the ribbon cable together for cost down consideration.

SUMMARY OF THE INVENTION

The primary purpose of the present invention is to provide an electrical connector for simultaneously connecting to a mother board, a daughter board, and a ribbon cable.

One aspect of the present invention is to provide an electrical connector comprising a body portion comprising a vertical portion and a horizontal portion connected to the vertical portion. A reception slot is defined in the vertical portion. A plurality of contacts are received within the body portion. Each contact includes a first section disposed in the reception slot and a second section disposed in the horizontal portion.

Another aspect of the present invention is to provide an electrical assembly comprising a body portion mounted on a mother board and comprising a vertical portion and a horizontal portion connected to the vertical portion. A reception slot is defined in the vertical portion. A daughter board is partially retained in the reception slot. A plurality of contacts are received within the body portion. Each contact includes a first section disposed in the reception slot and a second section disposed in the horizontal portion.

DETAILED DESCRIPTION OF THE PREFERRED EMBODIMENT

Figure 1:
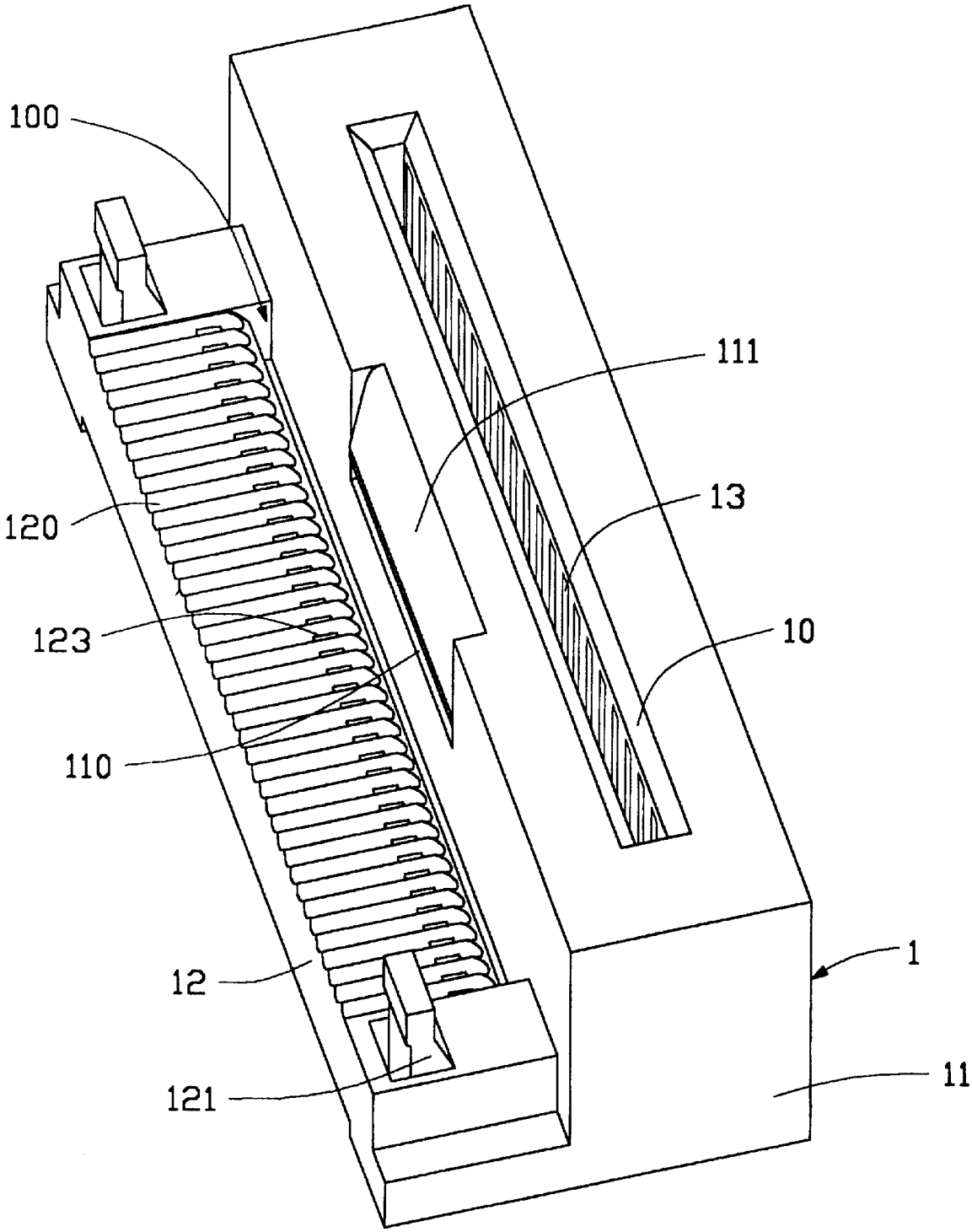
FIG. 1 is a perspective view of a body portion of an electrical connector in accordance with the present invention.
Figure 2:
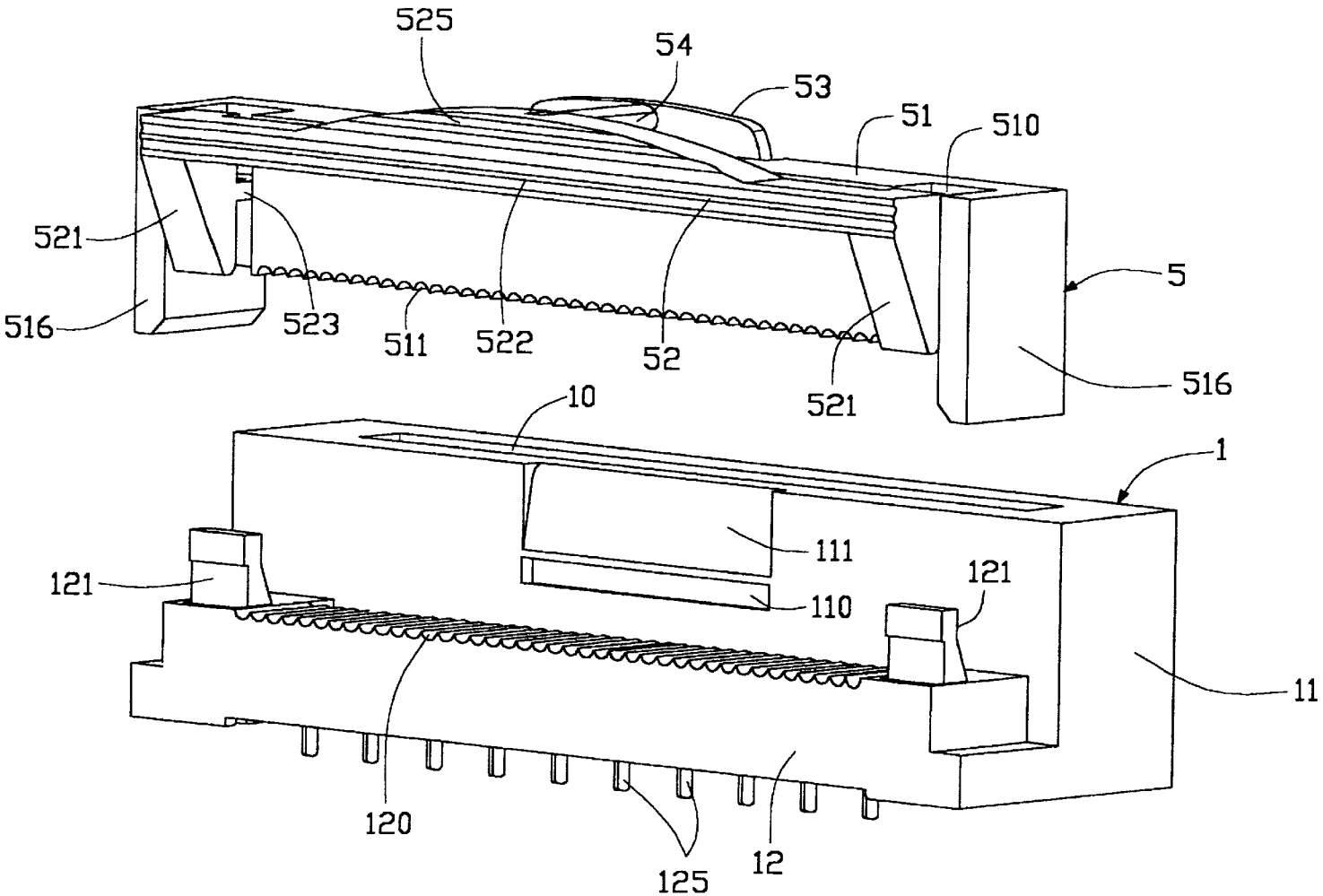
FIG. 2 is the body portion of FIG. 1 and a cover adapted to be engaged with the body portion.
Figure 4:
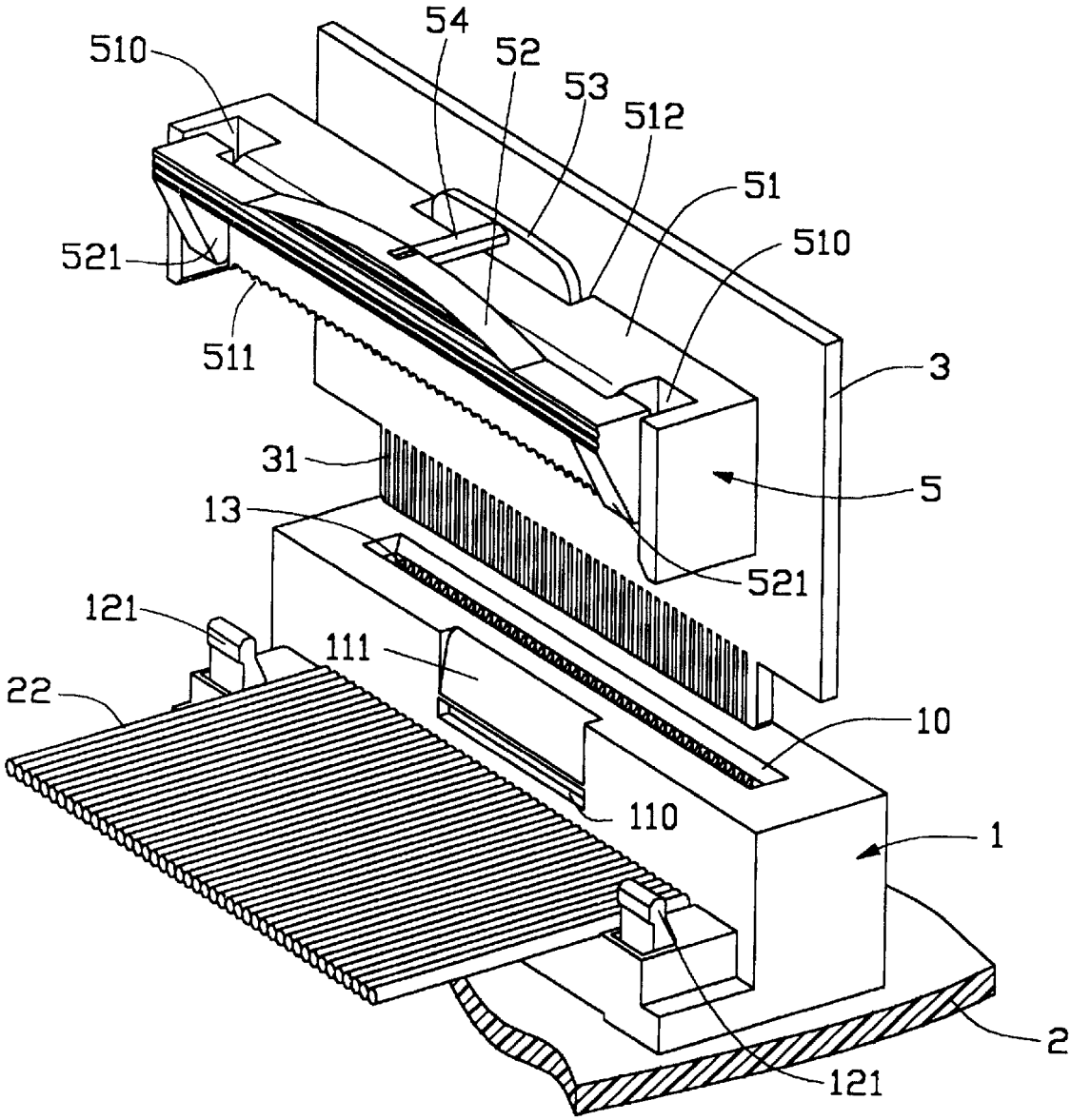
FIG. 4 is an exploded view of the electrical connector, where the body portion has been mounted on a mother board and a ribbon cable has been positioned on the body portion.

Refering to FIGS. 1 and 2, an electrical connector in accordance with the present invention comprises a body portion 1 and a cover 5 adapted to be detachably engaged with the body portion 1. They portion 1 is substantially L-shaped and comprises a vertical portion 11 and a horizontal portion 12 connected to the vertical portion 11. A reception slot 10 is defined in the vertical portion 11 for receiving a daughter board 3 (FIG. 4). A guiding slope face 111 is formed from a top edge to a middle level of the vertical portion 11. A recess 110 is defined in a front face of the vertical portion 11 under and near the guiding slope face 111. A slit 100 is defined at the horizontal portion 12 nearby the vertical portion 11.

Two hooks 121 are projected upward from two ends of the horizontal portion 12 and substantially parallel to the vertical portion 11. A plurality of shallow recesses 120 are defined in parallel along a top surface of the horizontal portion. A plurality of contacts 131 are received within the body portion 1 wherein each contact 131 includes a first section 13 disposed inside the reception slot 10 for mating with a daughter board 3, a second section 123 of a piercing type disposed in the horizontal portion 12 projecting upwardly from the corresponding shallow recess 120 for mating with a ribbon cable 22, and a tail portion 125 for mating with the mother board 2. The tail portions 125 extend downward from the horizontal portion 12 in several rows, herein only one row of the tail portions 125 being shown due to the viewing angle.

Figure 3:
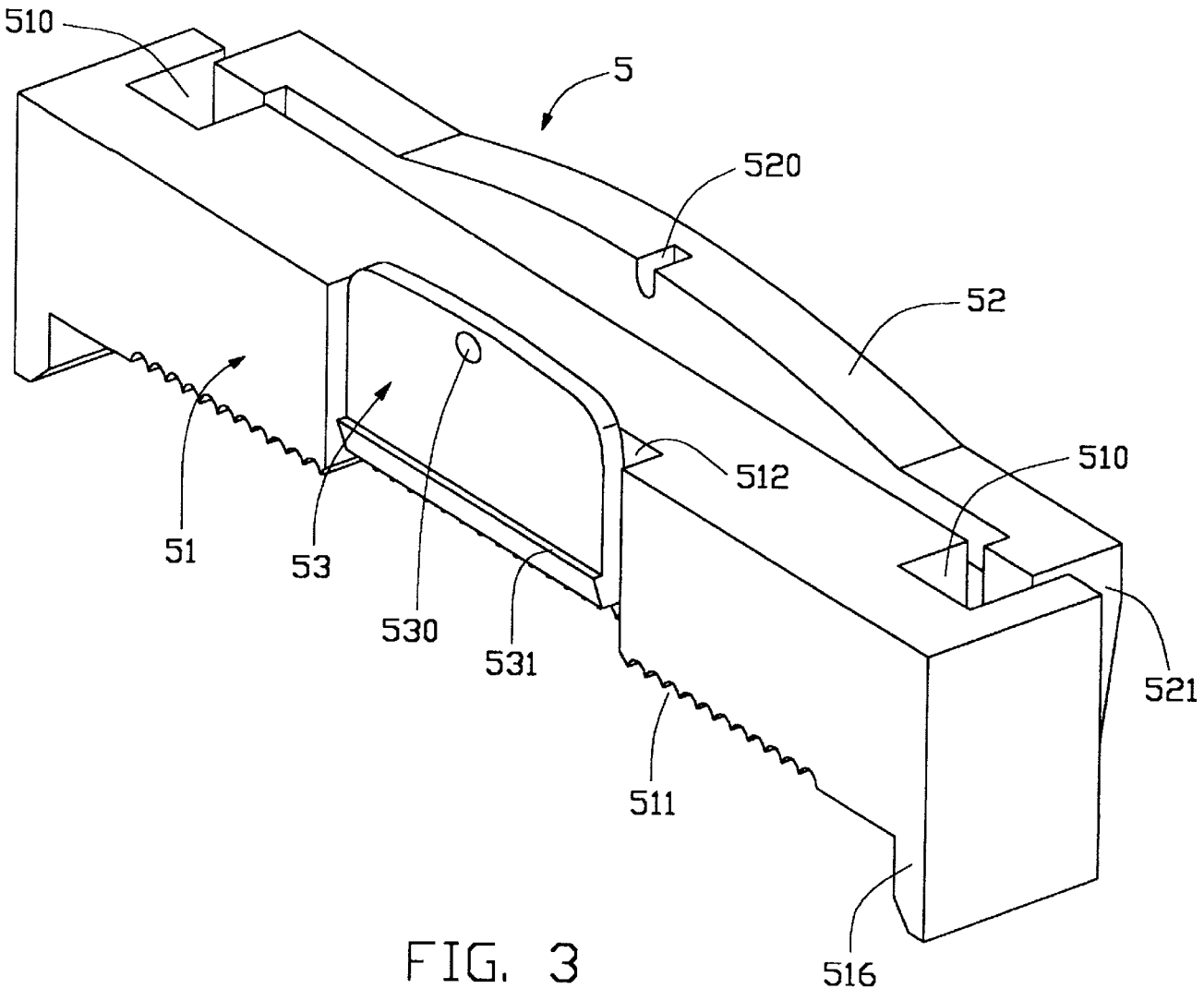
FIG. 3 is a perspective view of the cover taken from an opposite direction of FIG. 2, where a transmission rod is removed for showing the way to fix the transmission rod in the cover.

Also referring to FIG. 3, the cover 5 comprises a main body 51, a front fixing portion 52 and a rear fixing portion 53 respectively connected to opposite sides of the main body 51. The main body 51 is basically a plate having a waved bottom edge 511. Two legs 516 extend downward from two ends of the main body 51 and extend downward from two ends of the main body 51 and beyond the waved bottom edge 511. Two front cutouts 510 are defined beside the legs 516 and a rear cutout 512 is defined at a rear center portion of the main body 51.

Figure 6:
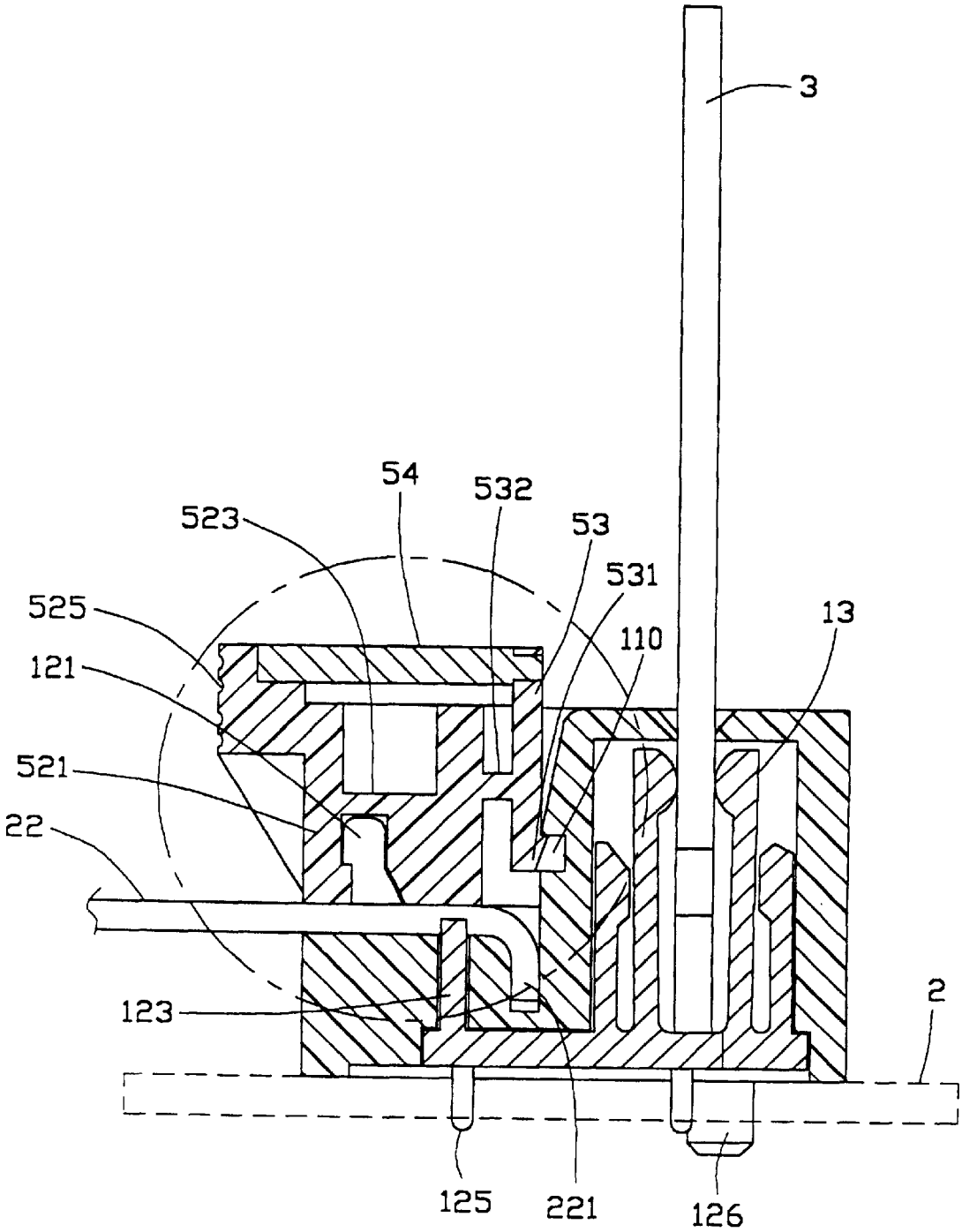
FIG. 6 is a schematic view showing the connections between the body portion, the cover, the mother board, the daughter board, and the ribbon cable.

The front fixing portion 52 has a beam 522 having a rough surface for increasing contacting resistance when operated by hands. Two front latches 521 extend downward from two ends of the beam 522 and each front latch 521 is connected to the main body 51 by a front rib 523 which is traversed to the front cutout 510. An arcuate flange 525 extends upward from the beam 522. A fastening slot 520 is defined at a top surface of the arcuate flange 525. The rear fixing portion 53 is basically a plate connected to the main body 51 via a rear rib 532 (see FIG. 6) which is traversed to the rear cutout 512. The rear fixing portion 53 has a rear latch 531 formed at a lower portion thereof and a fixing hole 530 defined in an upper portion thereof. A transmission rod 54 is connected between the front fixing portion 52 and the rear fixing portion 53 respectively at the fastening slot 520 and the fixing hole 530 thereof.

Referring to FIG. 4, a mother board 2, a daughter board 3, and a ribbon cable 22 are ready to be configured to the electrical connector of the present invention, wherein the body portion 1 of the electrical connector is electrically soldered to and mounted on the mother board 2, and the ribbon cable 22 has a front end 221 (see FIG. 6) being bent and retained in the slit 100 of the body portion 1 and a section thereof being positioned in the shallow recesses 120 of the horizontal portion 12 of the body portion 1. The daughter board 3 has one row or opposite rows of gold fingers 31 formed on an extending edge thereof for being electrically engaged with the inner contacts 13 of the electrical connector when inserted into the reception slot 10.

Figure 5:
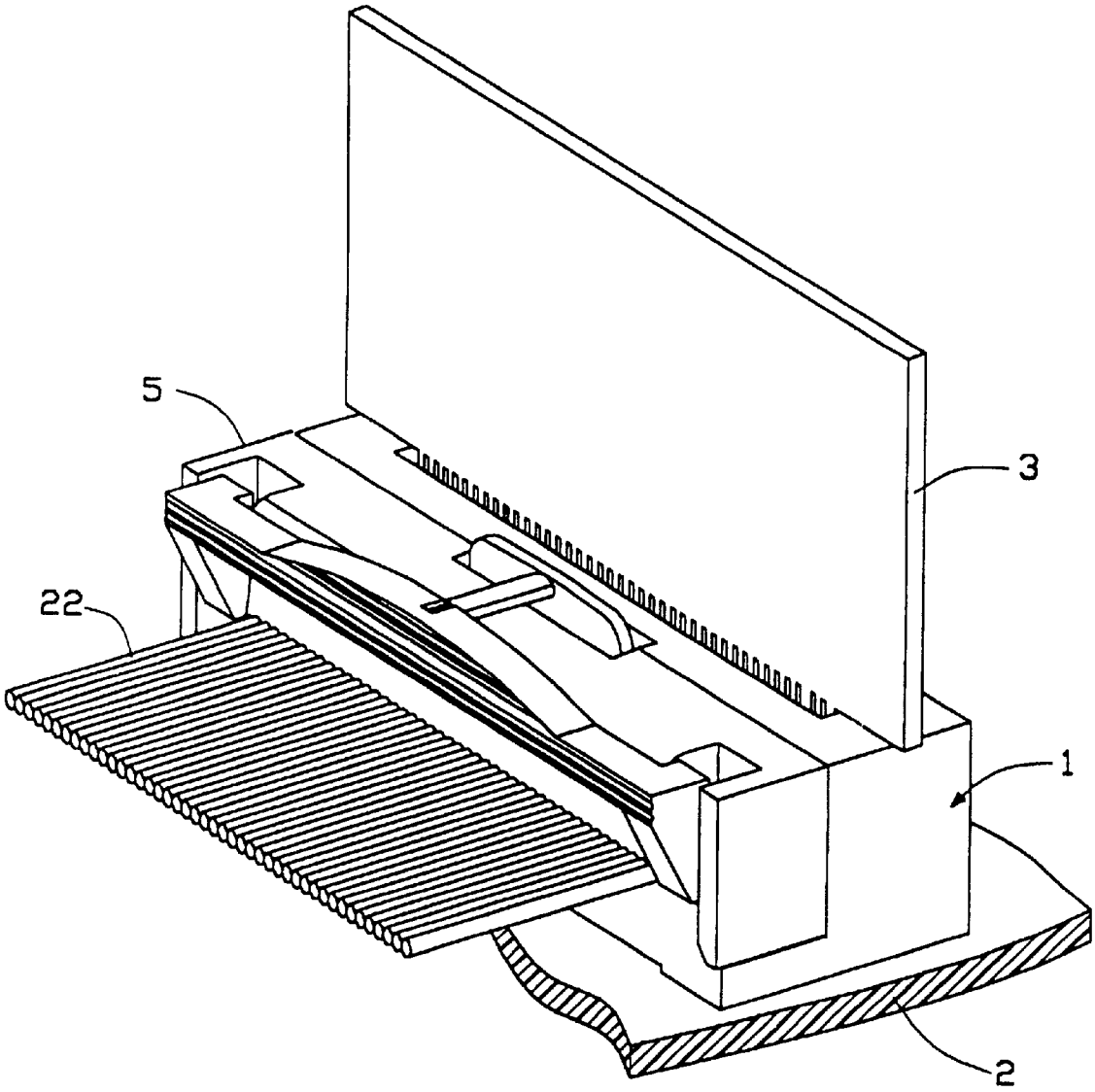
FIG. 5 is an assembled view of FIG. 4.

FIG. 5 is an assembled view of FIG. 4, wherein the daughter board 3 is electrically and mechanically engaged with the body portion 1 and the ribbon cable 22 is fixed between the cover 5. Also referring to FIG. 6, the configuration between the daughter board 3, the electrical connector, the ribbon cable 22 and the mother board 2 is shown in more detail.

In assembling, the daughter board 3 is inserted into the reception slot 10, so that the gold fingers 31 thereof are electrically engaged with the inner contacts 13. The cover 5 is fixed to the body portion 1 by engaging the front latches 521 with the hooks 121 and engaging the rear latch 531 with the recess 110. Simultaneously, the waved bottom edge 511 of the cover 5 depresses the section of the ribbon cable 22 positioned on the horizontal portion 12 for forcing the sectional ribbon cable 22 being cut opened by the piercing contacts 123 and causing electrical engagement between the ribbon cable 22 and the piercing contacts 123. The guiding slope face 111 is used to guide the rear latch 531 to slide therethrough and finally retained in the recess 110. Therefore, the daughter board 3, the mother board 2, and the ribbon cable 22 are electrically associated with each other via the interconnection of the electrical connector.

Figure 7:
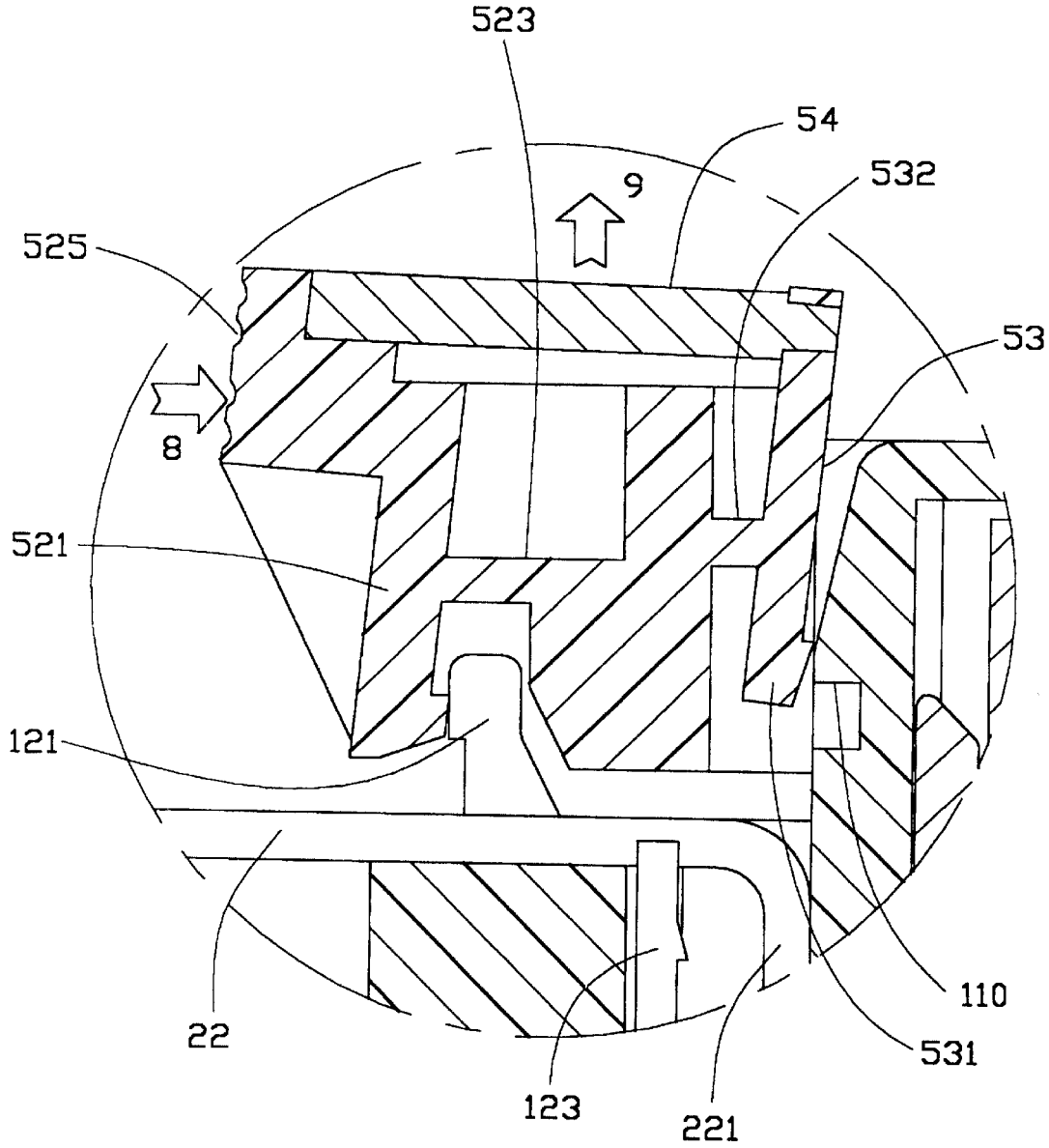
FIG. 7 is a schematic view showing disconnection of the cover from the body portion.

Referring to FIG. 7, the cover 5 may be released from the body portion 1 by applying a force along a horizontal direction 8 on the arcuate flange 525 of the front fixing portion 52 and then lifting the cover 5 along a vertical direction 9 immediately. More specifically, when the force is applied along the direction 8 on the arcuate flange 525 of the front fixing portion 52, the transmission rod 54 will transmit the force to the upper portion of the rear fixing portion 53 and force the front latches 521 and the rear fixing portion 53 to respectively perform a leverage action with respect to the front rib 523 and the rear rib 532 thereby causing the front latches 521 and the rear latch 531 to respectively disengage from the hooks 121 and the recess 110.

While the present invention has been described with reference to a specific embodiment, the description is illustrative of the invention and is not to be construed as limiting the invention. For example, the ribbon cable may be replaced with a flexible flat cable and the piercing contacts may be replaced with half bellow contacts for electrically contacting with the flexible flat cable. Therefore, various modifications to the present invention can be made to the preferred embodiment by, those skilled in the art without departing from the true spirit and scope of the invention as defined by the appended claims.

What is claimed is:

1. An electrical connector comprising:

a body portion comprising a vertical portion and a horizontal portion connected to the vertical portion, the vertical portion defining a guiding slope face formed at a front face thereof and a recess under the guiding slope face;

a reception slot defined in the vertical portion;

a plurality of contacts received within the body portion, each of said contacts including a first section disposed in the reception slot and adapted to electrically connect with a first electrical element, and an insulation piercing type second section disposed on the horizontal portion and adapted to electrically connect with a second electrical element; and a cover guided by the guiding slope face of the vertical portion to be detachably fixed to the horizontal portion for pressing the second electrical element to the second sections of the contacts on the horizontal portion, the cover having a rear latch engaged with the recess of the vertical portion.

2. The electrical connector as claimed in claim 1, wherein the horizontal portion has a hook extending upward and wherein the cover has a front latch for engagement with the hook.

3. The electrical connector as claimed in claim 1, wherein each of the second sections extends from a shallow recess in the horizontal portion.

4. An electrical assembly comprising:

a body portion mounted on a mother board and comprising a vertical portion and a horizontal portion connected to the vertical portion and comprising a hook extending upward;

a reception slot defined in the vertical portion;

a daughter board partially retained in the reception slot;

a plurality of contacts received within the body portion, each of said contacts including a first section disposed in the reception slot to electrically connect with the daughter board and a second section disposed in the horizontal portion;

a cover being detachably fixed to the horizontal portion and comprising a front latch engaging with the hook of the horizontal portion; and a ribbon cable being retained between the cover and the horizontal portion to electrically connect with the second sections of the contacts.

5. The electrical assembly as claimed in claim 4, wherein the second sections of the contacts are of insulation piercing type.

6. The electrical assembly as claimed in claim 4, wherein the vertical portion has a guiding slope face formed at a front face thereof for guiding the cover to fix to the horizontal portion.

7. The electrical assembly as claimed in claim 6, wherein the vertical portion has a recess defined under the guiding slope face and the cover comprises a rear latch to engage with the recess.

* * * * *